US009739011B2

(12) United States Patent
Tamper et al.

(10) Patent No.: US 9,739,011 B2
(45) Date of Patent: Aug. 22, 2017

(54) METHOD FOR PRODUCING NANOFIBRILLAR CELLULOSE

(71) Applicant: UPM-KYMMENE CORPORATION, Helsinki (FI)

(72) Inventors: Juha Tamper, Taipalsaari (FI); Markus Nuopponen, Helsinki (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 323 days.

(21) Appl. No.: 14/357,706

(22) PCT Filed: Nov. 14, 2012

(86) PCT No.: PCT/FI2012/051116
§ 371 (c)(1),
(2) Date: May 12, 2014

(87) PCT Pub. No.: WO2013/072559
PCT Pub. Date: May 23, 2013

(65) Prior Publication Data

US 2014/0284407 A1 Sep. 25, 2014

(30) Foreign Application Priority Data

Nov. 14, 2011 (FI) ..... 20116130

(51) Int. Cl.
*B02C 13/20* (2006.01)
*D21D 1/20* (2006.01)
*D21D 1/36* (2006.01)

(52) U.S. Cl.
CPC ..... *D21D 1/20* (2013.01); *B02C 13/205* (2013.01); *D21D 1/36* (2013.01)

(58) Field of Classification Search
CPC ..... D21D 1/20; D21D 1/36; B02C 13/205; B02C 13/20; B02C 19/0056
(Continued)

(56) References Cited

U.S. PATENT DOCUMENTS 3,894,695 A 7/1975 Benedikter
4,406,409 A 9/1983 Durek
(Continued)

FOREIGN PATENT DOCUMENTS

EP 2 377 658 A1 10/2011
FI 105112 B 6/2000
(Continued)

OTHER PUBLICATIONS

May 2, 2016 Office Action issued in European Patent Application No. 12849835.9.
(Continued)

*Primary Examiner* — Mark Rosenbaum
(74) *Attorney, Agent, or Firm* — Nixon Peabody LLP; Leena H. Karttunen Contarino; Elizabeth Baio

(57) ABSTRACT

In a method for producing nanofibril cellulose, cellulose based fiber material, in which internal bonds in the cellulose fiber have been weakened by chemical modification, are supplied, for separating fibrils, through several counter-rotating rotors outwards in the radial direction with respect to the rotation axis of the rotors in such a way that the material is repeatedly subjected to shearing and impacting forces by the effect of the blades of the different counter-rotating rotors, whereby it is simultaneously fibrillated.

17 Claims, 3 Drawing Sheets

A-A

(58) Field of Classification Search
USPC ..... 241/27, 188.1, 188.2
See application file for complete search history.

(56) References Cited

U.S. PATENT DOCUMENTS

| | | | |
|---|---|---|---|
| 5,730,376 | A | 3/1998 | Schneid et al. |
| 6,202,946 | B1 | 3/2001 | Virtanen |
| 8,480,018 | B2 | 7/2013 | Virtanen |
| 2002/0098317 | A1 | 7/2002 | Jaschinski et al. |
| 2007/0131360 | A1 | 6/2007 | Sipila et al. |
| 2011/0008638 | A1 | 1/2011 | Miyawaki et al. |
| 2011/0168821 | A1 | 7/2011 | Virtaven |

FOREIGN PATENT DOCUMENTS

| | | | |
|---|---|---|---|
| FI | 120733 | B | 2/2010 |
| GB | 379761 | A | 9/1932 |
| GB | 891152 | | 3/1962 |
| GB | 995464 | | 6/1965 |
| JP | 2002536507 | A | 10/2002 |
| JP | 2011074528 | A | 4/2011 |
| JP | 2011162608 | A | 8/2011 |
| WO | 98/29596 | A1 | 7/1998 |
| WO | WO 2010/092239 | A1 | 8/2010 |
| WO | WO 2011/064441 AI | | 6/2011 |
| WO | 2014/045209 | A1 | 3/2014 |

OTHER PUBLICATIONS

International Search Report issued in International Application No. PCT/FI2012/051116 dated Mar. 5, 2013.

International Preliminary Report on Patentability issued in International Application No. PCT/FI2012/051116 dated Feb. 3, 2014.

Sep. 8, 2105 extended Search Report issued in European Patent Application No. 12849835.9.

Feb. 28, 2015 Office Action issued in Chinese Patent Application No. 201280055509.5.

Japanese Office Action for Patent application No. 2014-541720. Dated Nov. 29, 2016. With English translation. 9 pp.

Sample 1022

Sample 1023

Sample 1025

METHOD FOR PRODUCING NANOFIBRILLAR CELLULOSE

FIELD OF THE INVENTION

The invention relates to a method for producing nanofibrillar cellulose, wherein cellulose based fibre material is supplied into a refining gap for separating fibrils.

BACKGROUND OF THE INVENTION

In the refining of lignocellulose-containing fibres by, for example, a disc refiner or a conical refiner at a low consistency of about 3 to 4%, the structure of the fibre wall is loosened, and fibrils or so-called fines are detached from the surface of the fibre. The formed fines and flexible fibres have an advantageous effect on the properties of most paper grades. In the refining of pulp fibres, however, the aim is to retain the length and strength of the fibres. In post-refining of mechanical pulp, the aim is partial fibrillation of the fibres by making the thick fibre wall thinner by refining, for detaching fibrils from the surface of the fibre.

Lignocellulose-containing fibres can also be totally disintegrated into smaller parts by detaching fibrils which act as components in the fibre walls, wherein the particles obtained become significantly smaller in size. The properties of so-called nanofibril cellulose thus obtained differ significantly from the properties of normal pulp. It is also possible to use nanofibril cellulose as an additive in papermaking and to increase the internal bond strength (interlaminar strength) and tensile strength of the paper product, as well as to increase the tightness of the paper. Nanofibril cellulose also differs from pulp in its appearance, because it is gel-like material in which the fibrils are present in a water dispersion. Because of the properties of nanofibril cellulose, it has become a desired raw material, and products containing it would have several uses in industry, for example as an additive in various compositions.

Nanofibril cellulose can be isolated as such directly from the fermentation process of some bacteria (including *Acetobacter xylinus*). However, in view of large-scale production of nanofibril cellulose, the most promising potential raw material is raw material derived from plants and containing cellulose fibres, particularly wood and fibrous pulp made from it. The production of nanofibril cellulose from pulp requires the decomposition of the fibres further to the scale of fibrils. In processing, a cellulose fibre suspension is run several times through a homogenization step that generates high shear forces on the material. This can be achieved by guiding the suspension under high pressure repeatedly through a narrow gap where it achieves a high speed. It is also possible to use refiner discs, between which the fibre suspension is introduced several times.

In practice, the production of nanofibril cellulose from cellulose fibres of the conventional size class can, at present, only be implemented by disc refiners of laboratory scale, which have been developed for the needs of food industry. This technique requires several refining runs in succession, for example 2 to 5 runs, to obtain the size class of nanocellulose. The method is also poorly scalable up to industrial scale.

BRIEF SUMMARY OF THE INVENTION

It is an aim of the invention to eliminate the above-mentioned drawbacks and to present a method by which nanofibril cellulose can be made with a good capacity and also at a higher consistency.

For achieving this aim, the method according to the invention is primarily characterized in that the fibre material is introduced through several counter-rotating rotors, outwards in the radial direction with respect to the axis of rotation of the rotors in such a way that the material is repeatedly subjected to shear and impact forces by the effect of the different counter-rotating rotors, whereby it is simultaneously fibrillated.

As a matter of great importance, the fibre material in suspension is repeatedly impacted by the blades or ribs of the rotors striking it from opposite directions when the blades rotate at the rotating speed and at the peripheral speed determined by the radius (distance to the rotation axis) in opposite directions. Because the fibre material is transferred outwards in the radial direction, it crashes onto the wide surfaces of the blades, i.e. ribs, coming one after each other at a high peripheral speed from opposite directions; in other words, it receives several successive impacts from opposite directions. Also, at the edges of the wide surfaces of the blades, i.e. ribs, which edges form a blade gap with the opposite edge of the next rotor blade, shear forces occur, which contribute to the fibrillation.

The fibre material to be processed is such cellulose in which the internal bonds of the fibre have already been weakened by chemical pretreatment. The cellulose is thus chemically modified cellulose. Such cellulose, which has already been suitably labilized before its mechanical processing, can be influenced surprisingly well by impacts which come from blades (ribs) at density in opposite directions and which can be produced by a series of successive rotors, and by shear forces generated at the edges of the blades (ribs) when the fibres are transferred from the range of action of one rotor to the range of action of the next rotor.

Furthermore, the fibrillation works well when the pH of the fibre suspension is in the neutral or slightly alkaline range (pH 6 to 9, advantageously 7 to 8). An elevated temperature (higher than 30° C.) also contributes to the fibrillation. With respect to the temperature, the normal operating environment for processing is usually 20 to 60° C. The temperature is advantageously between 35 and 50° C.

On the periphery of each rotor, there are several blades which, together with several blades of the preceding and/or next rotor in the radial direction, because of their rotary movement in opposite directions, repeatedly produce several narrow blade spaces or gaps, in which the fibres are also subjected to shear forces as the opposite edges of the blades, i.e. ribs, pass each other at a high speed when moving into opposite directions.

It can be stated that in each pair of counter-rotating rotors, a large number of narrow blade gaps and, correspondingly, reversals of impact directions, are generated during a single rotation of each rotor, the recurrence frequency being proportional to the number of blades i.e. ribs on the periphery. Consequently, the direction of impacts caused by the blades i.e. ribs on the fibre material is changed at a high frequency. The number of blade gaps during the rotations and their recurrence frequency depend on the density of the blades distributed onto the periphery of each rotor, and correspondingly on the rotation speed of each rotor. The number of such rotor pairs is n−1, where n is the total number of rotors, because one rotor always forms a pair with the next outer rotor in the radial direction, except for the outermost rotor, through which the processed pulp exits the refining process.

Different rotors may have different numbers of blades i.e. ribs, for example in such a way that the number of blades increases in the outermost rotors. The number of blades i.e. ribs can also vary according to another formula.

The density of the blades/ribs on the periphery of each rotor, as well as the angles of the blades to the radial direction, as well as the rotation speeds of the rotors can be used to affect the refining efficiency (the refining intensity) as well as the throughput time of the fibre material to be refined.

The fibrillation method based on impacts coming at a high frequency from different directions is particularly suitable for such cellulose based fibre materials, in which the internal bonds of the cellulose have been weakened by a chemical pretreatment, whereby the method can be used for producing nanofibril cellulose. The pre-treated cellulose can thus be carboxymethylated, oxidized (e.g. N-oxyl mediated oxidizations) or cationized.

Yet another advantage to be achieved by the method is the fact that it can also be used for refining fibre material at higher consistencies (2 to 4%) compared with e.g. a homogenizer, because gelling during refining of the same material several times does not require diluting of the material. The principle makes it possible to use even higher consistencies than this, wherein the density of the blades/ribs can be adjusted to correspond to the consistency used at the time.

The supplying can be implemented so that the mixture to be passed through the rotors contains a given volume part of a gaseous medium mixed in it, but as a separate phase, for example greater than 10 vol. %. For intensifying the separation of the fibrils, the content of gas is at least 50 vol. %, advantageously at least 70% and more advantageously between 80 and 99%; that is, expressed in degrees of filling (the proportion of the fibre suspension to be processed in the volume passing through the rotor) lower than 90 vol. %, not higher than 50%, not higher than 30% and correspondingly between 1 and 20%. The gas is advantageously air, wherein the fibre suspension to be processed can be supplied in such a way that a given proportion of air is admixed to the fibre suspension.

The method is also advantageous in the sense that it can be easily scaled larger, for example by increasing the number of rotors.

DESCRIPTION OF THE DRAWINGS

In the following, the invention will be described in more detail with reference to the appended drawings, in which.

DETAILED DESCRIPTION OF THE INVENTION

In this application, nanofibril cellulose refers to cellulose microfibrils or microfibril bundles separated from cellulose based fibre raw material. These fibrils are characterized by a high aspect ratio (length/diameter): their length may exceed 1 μm, whereas the diameter typically remains smaller than 200 nm. The smallest fibrils are in the scale of so-called elementary fibrils, the diameter being typically 2 to 12 nm. The dimensions and size distribution of the fibrils depend on the refining method and efficiency. Nanofibril cellulose can be characterized as a cellulose based material, in which the median length of particles (fibrils or fibril bundles) is not greater than 10 μm, for example between 0.2 and 10 μm, advantageously not greater than 1 μm, and the particle diameter is smaller than 1 μm, suitably ranging from 2 nm to 200 nm. Nanofibril cellulose is characterized by a large specific surface area and a strong ability to form hydrogen bonds. In water dispersion, nanofibril cellulose typically appears as either light or almost colourless gel-like material. Depending on the fibre raw material, nanofibril cellulose may also contain small amounts of other wood components, such as hemicellulose or lignin. Often used parallel names for nanofibril cellulose include nanofibrillated cellulose (NFC), which is often simply called nanocellulose, and microfibrillated cellulose (MFC).

In this application, the term "refining" or "fibrillation" generally refers to comminuting material mechanically by work applied to the particles, which work may be grinding, crushing or shearing, or a combination of these, or another corresponding action that reduces the particle size. The energy taken by the refining work is normally expressed in terms of energy per processed raw material quantity, in units of e.g. kWh/kg, MWh/ton, or units proportional to these.

The refining is performed at a low consistency for the mixture of fibre raw material and water, the fibre suspension. Hereinbelow, the term pulp will also be used for the mixture of fibre raw material and water subjected to refining. The fibre raw material subjected to refining may refer to whole fibres, parts separated from them, fibril bundles, or fibrils, and typically the pulp is a mixture of such elements, in which the ratios between the components are dependent on the refining stage.

Particularly in the case presented in this application, the "refining" or "fibrillation" takes place by means of impact energy utilizing a series of frequently repeated impacts having varying directions of action.

Figure 1:
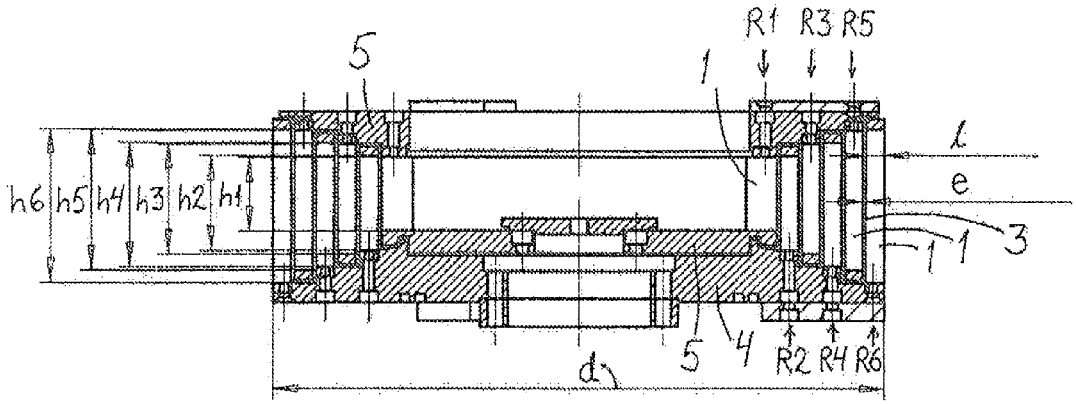
FIG. 1 shows the device used in the invention in a sectional plane A-A coinciding with the axis of rotation of the rotors.

The device shown in FIG. 1 comprises several counter-rotating rotors R1, R2, R3 . . . placed concentrically within each other so that they rotate around a common rotation axis RA. The device comprises a series of rotors R1, R3 . . . rotating in the same direction, and rotors R2, R4 . . . rotating in the opposite direction, wherein the rotors are arranged pairwise so that one rotor is always followed and/or preceded in the radial direction by a counter-rotating rotor. The rotors R1, R3 . . . rotating in the same direction are connected to the same mechanical rotating means 5. The rotors R2, R4 . . . rotating in the opposite direction are also connected to the same mechanical rotating means 4 but rotating in a direction opposite to the direction of the aforementioned means. Both rotating means 4, 5 are connected to their own drive shaft which is introduced from below. The drive shafts can be located concentrically with respect to the rotation axis RA, for example in such a way that the outer drive shaft is connected to a lower rotating means 4, and the inner drive shaft placed inside it and rotating freely with respect to it, is connected to an upper rotating means 5.

The figure does not show the fixed housing for the device, inside which the rotors are placed to rotate. The housing comprises an inlet, through which material can be supplied from above to the inside of the innermost rotor R1, and an outlet located by the side, oriented approximately tangentially outwards with respect to the peripheries of the rotors. The housing also comprises through-holes for the drive shafts down below.

Figure 2:
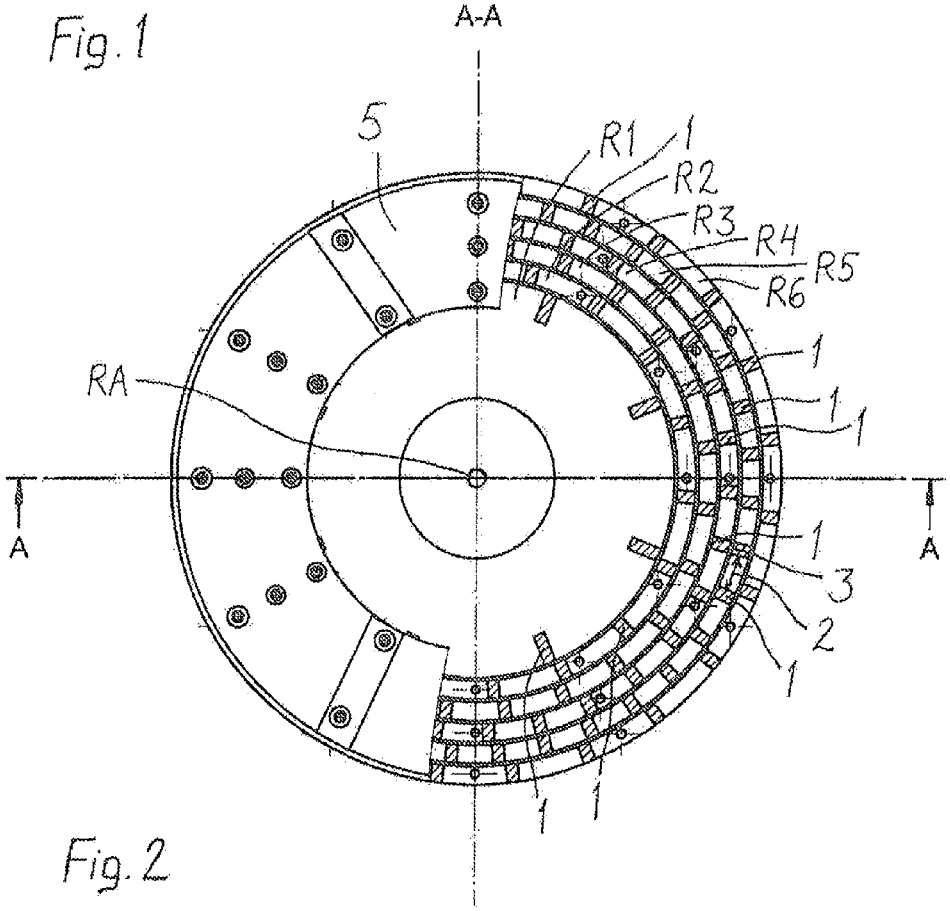
FIG. 2 shows the device of FIG. 1 in a partial horizontal section.

In practice, the rotors consist of vanes or blades 1 placed at given intervals on the periphery of a circle whose geometric centre is the rotation axis RA, and extending radially. In the same rotor, flow-through passages 2 are formed between the vanes 1, through which passages the material to be refined can flow radially outwards. Between two successive rotors R1, R2; R2, R3; R3, R4; etc., several blade spaces or gaps are formed repeatedly and at a high frequency during the rotary movement of the rotors in the opposite direction. In FIG. 2, reference numeral 3 denotes such blade gaps between the blades 1 of the fourth and fifth rotors R4, R5 in the radial direction. The blades 1 of the same rotor form narrow gaps, i.e. blade gaps 3, with the blades 1 of the preceding rotor (having the narrower radius on the periphery of the circle) in the radial direction and with the blades 1 of the next rotor (placed on the periphery of the circle with the greater radius) in the radial direction. In a corresponding manner, a large number of changes in the impact direction are formed between two successive rotors when the blades of the first rotor rotate in a first direction along the periphery of the circle, and the blades of the next rotor rotate in the opposite direction along the periphery of a concentric circle.

The first series of rotors R1, R3, R5 is mounted on the same mechanical rotating means 5 that consists of a horizontal lower disc and a horizontal upper disc, connected to each other by the blades 1 of the first rotor R1, innermost in the radial direction. On the upper disc, in turn, are mounted the blades 1 of the other rotors R3, R4 of this first series, with the blades 1 extending downwards. In this series, the blades 1 of the same rotor, except for the innermost rotor R1, are further connected at their lower end by a connecting ring. The second series of rotors R2, R4, R6 is mounted on the second mechanical rotating means 4 which is a horizontal disc placed underneath said lower disc, and to which the blades 1 of the rotors of the series are connected, to extend upwards. In this series, the blades 1 of the same rotor are connected at their upper end by a connecting ring. Said connecting rings are concentric with the rotation axis RA. The lower discs are further arranged concentrically by an annular groove and a matching annular protrusion on the facing surfaces of the discs, also placed concentrically with the rotation axis RA and being equally spaced from it.

FIG. 1 shows that the vanes or blades 1 are elongated pieces parallel to the rotation axis R1 and having a height greater than the width I (the dimension in the radial direction). In the horizontal section, the blades are quadrangular, in FIG. 2 rectangular. The fibre material is passed crosswise to the longitudinal direction of the blades, from the centre outwards, and the edges at the sides of the surfaces facing the radial direction in the blades 1 form long and narrow blade gaps 3 extending in the longitudinal direction of the blade, with the corresponding edges of the blades 1 of the second rotor.

The rotors R1, R2, R3 . . . are thus, in a way, through-flow rotors in the shape of concentric bodies of revolution with respect to the rotation axis, wherein their part that processes the fibre material consists of elongated vanes or blades 1 extending in the direction of the rotation axis RA, and of flow-through passages 2 left therebetween.

FIG. 1 also shows that the heights h1, h2, h3 . . . of the rotor blades 1 increase gradually from the first, i.e. the innermost rotor R1 outwards. As a result, the heights of the flow-through passages 2 limited by the rotor blades 1 also increase in the same direction. In practice, this means that when the cross-sectional area of the radial flow increases outwards as the peripheral length of the rotors increases, the increase in the height also increases this cross-sectional area. Consequently, the travel speed of a single fibre is decelerated in outward direction, if the volume flow is considered to be constant.

By the centrifugal force caused by the rotational movement of the rotors, the material to be processed is passed through the rotors with a given retention time.

As can be easily concluded from FIG. 2, during a single whole rotation of a pair of rotors (from a position in which given blades 1 are aligned, to the position in which the same blades 1 are aligned again), several blade gaps 3 are formed when successive blades 1 in the peripheral direction encounter successive blades 1 of the second rotor. As a result, the material transferred through the passages 2 outward in the radial direction is continuously subjected to shear and impact forces in the blade gaps 3 between different rotors and in the flow-through passages 2 between the blades 1 on the periphery of the rotor, when the material is passed from the range of the rotor to the range of an outer rotor, while the movement of the blades in peripheral direction and the directional changes of the movement caused by the rotors rotating in different directions prevent the through-flow of the material too fast out through the rotors by the effect of the centrifugal force.

Blade gaps 3 and, correspondingly, encounters of blades 1 and respective changes in the impact directions in two rotors successive in the radial direction are generated at a frequency of [1/s] which is $2\times f_r\times n_1\times n_2$, where $n_1$ is the number of blades 1 on the periphery of the first rotor, $n_2$ is the number of blades on the periphery of the second rotor, and $f_r$ is the rotational speed in revolutions per second. The coefficient 2 is due to the fact that the rotors rotate at the same rotational speed in opposite directions. More generally, the formula has the form $(f_r(\mathbf{1})+f_r(\mathbf{2}))\times n_1\times n_2$, where $f_r(\mathbf{1})$ is the rotational speed of the first rotor and $f_r(\mathbf{2})$ is the rotational speed of the second rotor in the opposite direction.

Furthermore, FIG. 2 shows how the number of blades 1 may be different in different rotors. In the figure, the number of blades 1 per rotor increases starting from the innermost rotor, except for the last rotor R6 where it is smaller than in the preceding rotor R5. As the rotational speeds (rpm) are equal irrespective of the location and direction of rotation of the rotor, this means that the frequency at which the blades 3 pass a given point and, correspondingly, the frequency of formation of the blade gaps 3 increases from the inside outwards in the radial direction of the device.

Figure 3:
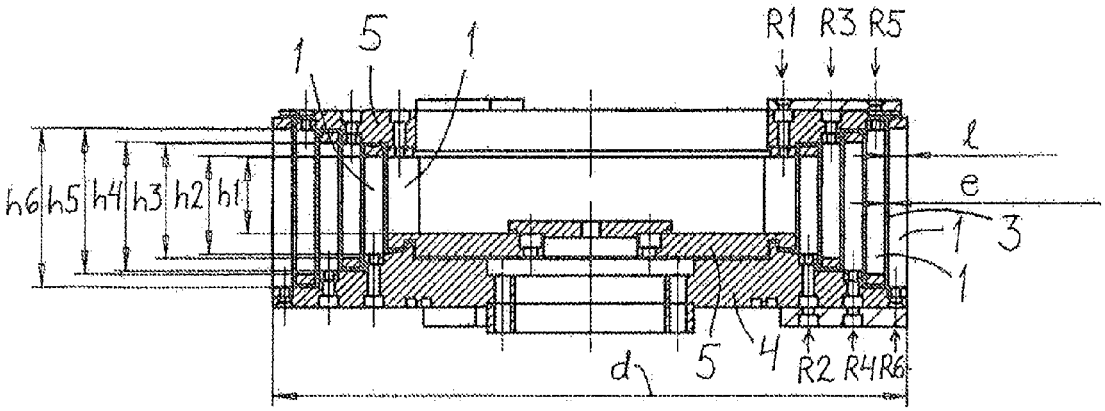
FIG. 3 shows the device according to a second embodiment used in the invention in a sectional plane A-A coinciding with the axis of rotation of the rotors.
Figure 4:
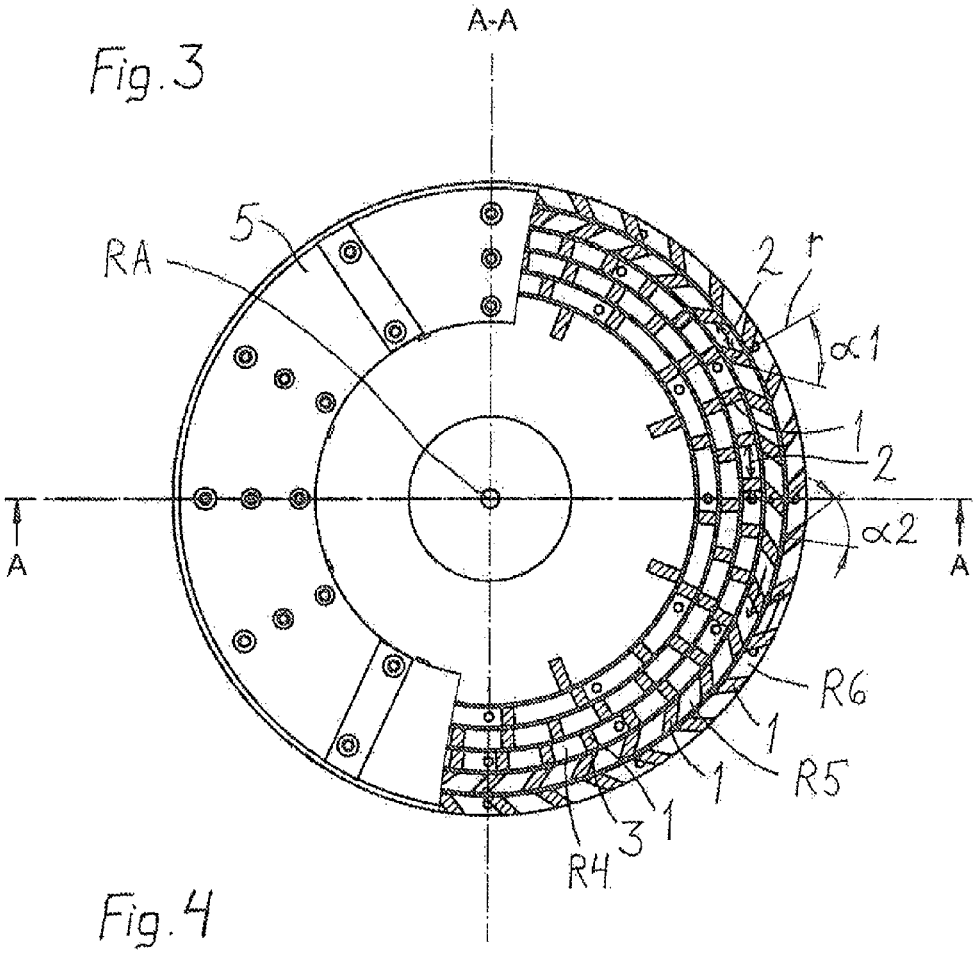
FIG. 4 shows the device of FIG. 3 in a partial horizontal section.

FIGS. 3 and 4 show a device having a principle and a structure similar to that shown in FIGS. 1 and 2. The difference is that the last two rotors R5 and R6 which rotate in different directions, are equipped with blades 1 placed at an angle to the direction of the radius r, whereas the blades in the other rotors are parallel to the radius r. In the last but one rotor R5, those surfaces of the blades 1 which limit the flow-through passages 2, are at an angle $\alpha\mathbf{1}$ to the radius 4 on the side of the direction of rotation; in other words, their outer edge is ahead of the inner edge in the peripheral direction. Moreover, in the last rotor R6, the blades are turned at an angle $\alpha\mathbf{2}$ to the radius, towards the direction of rotation. The blade angles of the different rotors are equal, but they can also be unequal. The angles $\alpha\mathbf{1}$, $\alpha\mathbf{2}$ can be between 30 and 60°. In FIG. 4, the angles $\alpha\mathbf{1}$, $\alpha\mathbf{2}$ are 45°. Because of the angular position of the blades 1, they have the shape of a parallellogram in a horizontal cross-section.

When the blades 1 are turned in the above-described way towards the rotation direction, they can be used to retain the fibre material to be processed more efficiently in the range of the rotor blades, and to increase the retention time and the processing efficiency. Also in the other rotors, blades can be placed at an angle to the radius in such a way that the angle is formed on the side of the rotation direction. The angles can also vary in different rotors, for example in such a way that the angle increases from the inside outwards. In the inner rotors, the angle can be smaller than in the outer rotors. The situation is, in a way, the same in FIG. 4 as well, because there the angle to the radius r is 0 in all the other rotors except said last two rotors.

In FIGS. 1 and 3, the dimension I of the blades in the direction of the radius r is 15 mm, and the dimension e of the blade gap 3 in the same direction is 1.5 mm. Said values may vary, for example from 10 to 20 mm and from 1.0 to 2.0 mm, respectively. The dimensions are influenced by, for example, the consistency of the material to be processed.

The diameter d of the device, calculated from the outer rim of the outermost rotor R6, can vary according to the capacity desired. In FIGS. 1 and 3, the diameter is 500 mm, but the diameter can also be greater, for example greater than 800 mm. When the diameter is increased, the production capacity increases in a greater proportion than the ratio of the diameters.

It has been found that a decrease in the rotation speed of the rotors impairs fibrillation. Similarly, a decrease in the flow rate (production) clearly improves fibrillation; in other words, the greater the retention time of the material to be processed during which it is subjected to the impact and shear forces of the blades i.e. ribs, the better the fibrillation result.

In the above described process, the material to be processed for producing nanofibril cellulose is a mixture of water and cellulose based fibre material where the fibres have been separated from each other in the preceding manufacturing processes of mechanical pulp or chemical pulp, where the starting material is preferably wood raw material. In the manufacture of nanofibril cellulose, it is also possible to use cellulose fibres from other plants, where cellulose fibrils are separable from the fibre structure. A suitable consistency of the low-consistency pulp to be refined is 1.5 to 4.5%, particularly at least 2%, preferably 2 to 4% (weight/weight) in an aqueous medium. The pulp is thus sufficiently dilute so that the starting material fibres can be supplied evenly and in sufficiently swollen state to open them up and to separate the fibrils. It is also possible that the material is fibre material that has already passed the same process once or more times, and from which fibrils have already been separated. When the material is already partly gelled as a result of the preceding processing runs, the material can be run at the same relatively high consistency (in view of the gel-like state). However, it should be noted that thanks to the modification possibilities provided by the method (inter alia, the blade density, the rotation speeds and, correspondingly, the peripheral speeds, impact frequencies, etc.), the consistency of the pulp to be processed may vary within a wide range, from 1 to 10%.

Fibre material at a given consistency in water is supplied in the above-described way through the rotors R1, R2, R3 . . . until it has been gelled and has achieved a viscosity typical of nanofibril cellulose. If necessary, the processing is repeated once or several times by running the material through the rotors again, or through another similar series of rotors, wherein the device comprising two or more of the above described sets of rotors can be coupled in series.

Advantageously, the cellulose based fibres of the pulp to be supplied are enzymatically or chemically pre-processed, for example to reduce the quantity of hemicellulose. The cellulose fibres are also chemically modified, wherein the cellulose molecules have, compared with the original cellulose, other functional groups, and the internal bonds in the cellulose fibre have thereby been weakened; in other words, the cellulose is labilized. Such groups include, for example, carboxyl groups or quaternary ammonium (cationic pulp). Carboxyl groups can be provided in cellulose molecules in a known way by, for example, N-oxyl mediated cellulose oxidation, one example being oxidation by the "TEMPO" chemical. The fibre raw material can also be carboxymethylated cellulose.

As the final result, the nanofibril cellulose suspension obtained after several refining runs is a gel with strongly shear thinning properties. Typically, its viscosity is measured by a Brookfield viscometer. Complete fibrillation of the fibres takes place as a function of energy consumption, and the proportion of non-disintegrated pieces of fibre wall contained in nanofibril cellulose is measured by, for example, Fiberlab equipment.

By refining by the method according to the invention, if necessary by repeating the refining, i.e. by feeding the same fibre material twice or several times through the device or successively through devices coupled in series, it is possible to obtain nanofibril cellulose, in which the viscosity of the aqueous dispersion increases as a function of the specific energy (energy consumption), that is, as the specific energy used for refining increases. Consequently, the viscosity of the product and the specific energy used in the method have a positive correlation. It has also been found that nanofibril cellulose can be obtained by refining, whereby the turbidity and the content of fibre particles reduces as a function of specific energy (energy consumption).

Typically in the method, the aim is to obtain, as the final product, nanofibril cellulose whose Brookfield viscosity, measured at a consistency of 0.8%, is at least 1000 mPa·s, advantageously at least 5000. It can be, for example, pulp that has been oxidized catalytically before the refining (pulp containing carboxyl groups), for example oxidized by N-oxyl mediation (such as the TEMPO catalyst), which meets said value. With oxidized pulp as the starting medium, the aim is advantageously to obtain nanofibril cellulose whose Brookfield viscosity measured at a consistency of 0.8% is at least 10,000 mPa·s, for example between 10,000 and 20,000. In addition to the high viscosity, the aqueous nanofibril cellulose dispersions obtained are also characterized by so-called shear thinning; that is, the viscosity decreases as the shear rate increases.

Furthermore, the aim is to obtain nanofibril cellulose whose turbidity is typically lower than 80 NTU, advantageously from 20 to 60 NTU, at a consistency of 0.1 wt-% (aqueous medium), measured by nephelometry.

Furthermore, the aim is obtain shear thinning nanofibril cellulose having a zero shear viscosity ("plateau" of constant viscosity at small shearing stresses) in the range of 2,000 to 50,000 Pa·s and a yield stress (shear stress where shear thinning begins) in the range of 3 to 30 Pa, advantageously in the range of 6 to 15 Pa, measured at a consistency of 0.5 wt-% (aqueous medium).

In the definitions above, the consistencies refer to consistencies, at which the measurements are taken, and they are not necessarily consistencies of the product obtained by the method.

In the following, test runs taken for the invention will be discussed.

The starting pulp was bleached birch pulp, TEMPO oxidized by the standard method. The charge of the starting pulp was determined by conductometric titration, and it was 1.2 mmol/g.

Equipment:

A: "Atrex" mixer, model G30, diameter 500 mm, 6 rotor peripheries, rotation speed applied 1500 rpm (counter-rotating rotors).

M: Masuko Supermasscolloider, modelMKZA10-15J

F: Fluidisator, Microfluidics M110Y

In the "method" column, the letter denoting the device is followed by the refining consistency expressed percent, and the number of runs through, separated by a point in the case of more than one run.

The results are presented in the following table. The turbidity values were obtained by nephelometry from a sample at a consistency of 0.1%. The viscosity is Brookfield viscosity determined at a consistency of 0.8%, at the rotation speed of 10 rpm.

| sample | method | turbidity (NTU) | viscosity (mPa · s) |
|---|---|---|---|
| 1019 | TA 1.2 | 35 | 10984 |
| 1020 | TA 1.4 | 32 | 33454 |
| 1021 | TA 2.2 | 57 | 10481 |
| 1022 | TA 2.4 | 13 | 45630 |
| 1023 | TM 1 | 48 | 36086 |
| 1024 | TM 2 | 41 | 40189 |
| 1025 | TF1 | 19 | 60982 |
| 1026 | TF2 | 16 | 49075 |

The methods for measuring turbidity and viscosity will be presented briefly in the following.

Turbidity:

The turbidity can be measured quantitatively by optical methods operating by two different physical measuring methods: measuring the loss of intensity of light in a sample (turbidimetry), and measuring the emission of light scattered from particles of a sample (nephelometry).

Nanofibril cellulose is substantially transparent in an aqueous medium. More fibrillated materials have a lower turbidity expressed in NTU units (nephelometric turbidity units). Consequently, the measurement of turbidity suits particularly well for the characterization of nanofibril cellulose. In the measurements, HACH P2100 equipment was used. The sample was made by mixing a product quantity corresponding to a dry matter content of 0.5 g in water in such a way that the total amount became 500 g, after which the sample was divided into different measuring vessels for analysis.

Viscosity:

The viscosity of nanofibril cellulose was measured by Brookfield RVDV-III rotation viscosimeter by selecting a sensor "vane spindle" (number 73). The product was diluted with water to a consistency of 0.8 wt-%, and the sample was agitated for 10 min before the measurement. The temperature was adjusted to the range of 20° C.±1° C.

Figure 5:
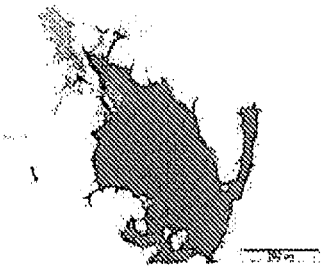
FIGS. 5 to 7 show samples of materials refined with the device.
Figure 6:
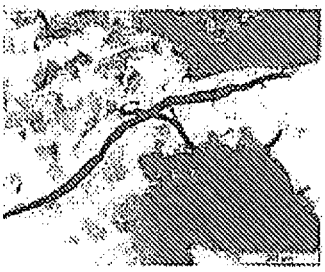
Figure 7:
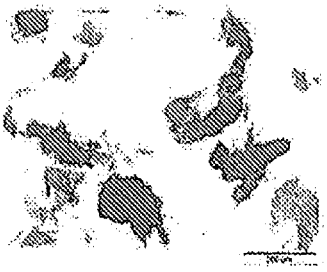

FIGS. 5 to 7 show photomicroscopic images of samples 1022, 1023 and 1025 obtained from test runs. As seen in the images, the product fibrillated by the method according to the invention (equipment A), sample 1022, does not differ in its appearance from the samples 1023 and 1025 obtained by known reference methods.

Thanks to its rheological properties, fibril strength properties, as well as the translucency of the products made from it, the nanofibril cellulose obtained by the method can be applied in many uses, for example as a rheological modifier and a viscosity regulator, and as elements in different structures, for example as a reinforcement. Nanofibril cellulose can be used, among other things, in oil fields as a rheological modifier and a sealing agent. Similarly, nanofibril cellulose can be used as an additive in various medical and cosmetic products, as a reinforcement in composite materials, and as an ingredient in paper products. This list is not intended to be exhaustive, but nanofibril cellulose can also be applied in other uses, if it is found to have properties suitable for them.

The invention claimed is:

1. A method for producing nanofibril cellulose, wherein cellulose based fibre material, in which internal bonds in the cellulose fibre have been weakened by chemical modification, are introduced in a refining gap for separating fibrils, wherein the fibre material is supplied through several counter-rotating rotors outwards in the radial direction with respect to the rotation axis of the rotors in such a way that the material is repeatedly subjected to shear and impact forces by the effect of the blades of the different counter-rotating rotors, whereby it is simultaneously fibrillated, wherein the fibrillation is effected by means of impact energy utilizing a series of frequently repeated impacts having varying directions of action caused by several successive impacts from opposite directions, when the fibre material in suspension is repeatedly impacted by the blades of the rotors striking it from opposite directions when the blades rotate in opposite directions at a rotating speed and at a peripheral speed determined by the distance to the rotation axis of the rotors.

2. The method according to claim 1, wherein the fibre material is supplied at a consistency of at least 1%.

3. The method according to claim 1, wherein the fibre material to be supplied is partly gelled.

4. The method according to claim 1, wherein the cellulose is cellulose oxidized by N-oxyl mediated oxidation.

5. The method according to claim 1, wherein the cellulose is carboxymethylated cellulose.

6. The method according to claim 1, wherein the cellulose is cationized cellulose.

7. The method according to claim 1, wherein the cellulose based fibre material is processed by supplying it through the rotors until it has achieved a Brookfield viscosity of at least 1,000 mPa·s, measured at a consistency of 0.8%.

8. The method according to claim 1, wherein the cellulose based fibre material is processed by supplying it through the rotors until it has achieved a turbidity value lower than 80 NTU, measured at a consistency of 0.1%.

9. The method according to claim 1, wherein the cellulose based fibre material is processed by supplying it through the rotors until it has achieved a zero shear viscosity of 2,000 to 50,000 Pa·s and a yield stress of 3 to 30 Pa, measured at a consistency of 0.5%.

10. The method according to claim 1, further comprising providing the rotors having blades which are oriented with respect to the direction of the radius at an angle towards the rotation direction.

11. The method according to claim 10, wherein in at least one rotor, all of the blades are oriented with respect to the direction of the radius at an angle towards the rotation direction.

12. The method according to claim 10, wherein in at least one rotor, more than one of the blades are oriented with respect to the direction of the radius at an angle towards the rotation direction.

13. The method according to claim 1, wherein the fibre material is supplied with a gaseous medium through the rotors.

14. The method according to claim 1, wherein the fibre material is supplied at a consistency of 2 to 4%.

15. The method according to claim 1, wherein the cellulose based fibre material is processed by supplying it through the rotors until it has achieved a Brookfield viscosity of at least 5,000 mPa·s measured at a consistency of 0.8%.

16. The method according to claim 1, wherein the cellulose based fibre material is processed by supplying it through the rotors until it has achieved a turbidity value of 20 to 60 NTU, measured at a consistency of 0.1%.

17. The method according to claim 1, wherein the cellulose based fibre material is processed by supplying it through the rotors until it has achieved a zero shear viscosity of 2,000 to 50,000 Pa·s and a yield stress of 6 to 15 Pa, measured at a consistency of 0.5%.

* * * * *